US007017219B2

(12) United States Patent
Fuessinger et al.

(10) Patent No.: US 7,017,219 B2
(45) Date of Patent: Mar. 28, 2006

(54) DISMOUNTABLE BRIDGE

(75) Inventors: Reinhold Fuessinger, Friedrichshafen (DE); Werner Duerr, Bermatingen (DE)

(73) Assignee: Eurobridge Mobile Bruecken GmbH, Friedrichshaften (DE)

( * ) Notice: Subject to any disclaimer, the term of this patent is extended or adjusted under 35 U.S.C. 154(b) by 0 days.

(21) Appl. No.: 10/785,477

(22) Filed: Feb. 25, 2004

(65) Prior Publication Data

US 2004/0231074 A1 Nov. 25, 2004

(30) Foreign Application Priority Data

Feb. 25, 2003 (DE) ..... 103 07 858

(51) Int. Cl.
*E01D 15/12* (2006.01)

(52) U.S. Cl. ..... 14/2.4; 14/24; 14/26

(58) Field of Classification Search ..... 14/2, 14/2.4, 2.5, 2.6, 3, 4, 74.5, 77.1, 24, 78, 26
See application file for complete search history.

(56) References Cited

U.S. PATENT DOCUMENTS

| | | | | | |
|---|---|---|---|---|---|
| 2,366,916 | A | * | 1/1945 | Le Tourneau | 14/2.4 |
| 2,367,291 | A | * | 1/1945 | Le Tourneau | 14/2.4 |
| 3,411,167 | A | * | 11/1968 | Sedlacek | 14/2.4 |
| 3,594,840 | A | * | 7/1971 | Loustalet et al. | 14/11 |
| 4,017,932 | A | * | 4/1977 | Lotto et al. | 14/2.4 |
| 4,169,296 | A | * | 10/1979 | Wipkink et al. | 14/71.1 |
| 4,521,932 | A | * | 6/1985 | Parramore | 14/2.5 |
| 4,953,249 | A | * | 9/1990 | Warwick | 14/2.4 |
| 4,962,556 | A | * | 10/1990 | Helmke et al. | 14/2.4 |
| 4,972,538 | A | * | 11/1990 | Parramore | 14/2.5 |
| 5,042,101 | A | | 8/1991 | Huether | 14/2.4 |
| 5,293,658 | A | * | 3/1994 | Huther | 14/2.4 |
| 5,423,101 | A | * | 6/1995 | Diefendahl et al. | 14/2.4 |
| 5,491,861 | A | * | 2/1996 | Penuela | 14/7 |
| 5,526,544 | A | * | 6/1996 | Wiedeck et al. | 14/2.4 |
| 6,611,982 | B1 | * | 9/2003 | Eberl et al. | 14/2.5 |

FOREIGN PATENT DOCUMENTS

| | | | |
|---|---|---|---|
| AT | 145 895 | | 1/1936 |
| DE | 38 14 502 | | 9/1989 |
| DE | 19724771 | C * | 10/1998 |
| DE | 19858328 | C1 * | 3/2000 |
| EP | 256446 | A2 * | 2/1988 |
| EP | 259719 | A2 * | 3/1988 |
| EP | 407235 | A1 * | 1/1991 |

(Continued)

*Primary Examiner*—Thomas B. Will
*Assistant Examiner*—Alexandra Pechhold
(74) *Attorney, Agent, or Firm*—Crowell & Moring LLP

(57) ABSTRACT

A dismountable bridge, having two track carriers which, viewed in the longitudinal direction of the bridge, are divided into several identical modules, in which case the two track carriers are each spanned by a vault and are suspended at the latter. The vaults are divided into several modules in the longitudinal direction of the bridge and are adapted in their modular division to the modular division of the track carriers. The vaults and the track carriers are equipped at their ends with end pieces. The modules of the vaults have mutually identical constructions and the end pieces of the vaults are connected in a torque-resistant manner with the end pieces of the respective track carriers. The end pieces are constructed such that they are capable of compensating the length differences between the track carriers and the vaults in the case of different bridge lengths.

20 Claims, 3 Drawing Sheets

FOREIGN PATENT DOCUMENTS

| | | | | |
|---|---|---|---|---|
| EP | 563872 | A1 | * | 10/1993 |
| FR | 2597129 | A1 | * | 10/1987 |
| FR | 2608186 | A1 | * | 6/1988 |
| GB | 2196674 | A | * | 5/1988 |
| GB | 2203183 | A | * | 10/1988 |
| WO | WO 9856994 | A1 | * | 12/1998 |

* cited by examiner

BM

BM

BM

DISMOUNTABLE BRIDGE

BACKGROUND AND SUMMARY OF THE INVENTION

This application claims the priority of German Document No.: 103 07 858.4-25, filed Feb. 25, 2003, the disclosure of which is expressly incorporated by reference herein.

The invention relates to a dismountable, that is, transportable bridge for a mobile use. Certain preferred embodiments of the invention relate to a dismountable bridge, having two track carriers which, viewed in a longitudinal direction of the bridge, are divided into several identical modules, the two tack carriers each being spanned by and being suspended at a vault, the vaults being divided into several modules in the longitudinal direction of the bridge, the vaults being adapted in their modular division to the modular division of the track carriers, the vaults and the track carriers being equipped at their ends with ends pieces.

When transportable bridges are used, they should correspond to the required span as well as to the required load, so that no excessive quantities of material have to be transported over long distances. This means that, by means of their construction, transportable bridges should adapt themselves to the obstacle and to the load. This is particularly important when the bridges are to reach their usage destination per air freight.

Several modular bridge concepts are known for adapting mobile bridges to the required load:

Double-Walled Construction

Here, two track carriers are arranged parallel side-by-side on both sides of a bridge. This solution is not mass-optimal because the moments of inertia of the two parallel carriers only add up, and so do their masses.

Double-Deck Construction

Here, two track carriers are arranged above one another on both sides of the bridge. Although the moment of inertia rises with twice the track carrier height, the bottom chord of the top track carrier as well as the top chord of the bottom track carrier come to be situated close to the neutral axis, contributing no longer to the overall bearing capacity, and thereby represent a "dead mass".

Trussing

In this case, the two track carriers are trussed by means of a strut frame with one or more posts, which also contains the possibility of a prestressing. Disadvantages: The space required for the trussing below the bridge girder is not always available. In addition, the adjusted prestress has to be ensured for the entire duration of the usage.

Vertically Adjustable Structure (DE 38 14 502 A1 (Corresponding U.S. Pat. No. 5,042,101)

Here, longitudinally adjustable frame members permit the adaptation of the track carrier height to the intended load, so that approximately always the same member forces occur. Disadvantage: The bearing structure of the bridge becomes a mechanism which has to be actively adjusted or regulated.

In Austrian Patent Document AT 145 895, a bridge of the above-mentioned type is described in the case of which the track carriers are each spanned by a vault and are suspended at the latter. In the longitudinal direction of the bridge, the track carriers as well as the vaults are divided into several modules. The track carrier modules have a mutually identical construction, while the vault modules, as a function of their position along the longitudinal direction of the bridge and of the local slope existing there with respect to the horizonal line, have different lengths. In the case of this bridge, a reduction of the span takes place in that, symmetrically to the bridge center, two bridge modules are removed which each consist of the track carrier module, the vault module and the suspension rod. In a bridge shortened in this manner, the pertaining vault module in each bridge module maintains its original slope in each bridge module; only the length of the pertaining suspension rod of this and further bridge modules has to be adapted. Because of this construction principle, the lengths, measured in the direction of the bridge span, of the vaults and the track carriers always coincide for any possible bridge length. However, in the case of this bridge, a larger number of vault modules of different lengths has to be present. This complicates the transport and the construction and leads to relatively long construction times of the bridge. If one of the bridge modules is lost, it cannot easily be replaced by another. These characteristics are not tolerable for military bridges which can be transported by air and in the case of which rapidity during the transport and construction as well as robustness are the most important features.

It is an object of the present invention to provide a modular-construction mobile bridge which, while the above-mentioned disadvantages of the state of the art are avoided, is characterized by a high variability and can be flexibly adapted to the obstacle and the load.

This object is achieved according to certain preferred embodiments of the invention by providing a dismountable bridge, having two track carriers which, viewed in a longitudinal direction of the bridge, are divided into several identical modules, the two track carriers each being spanned by and being suspended at a vault, the vaults being divided into several modules in the longitudinal direction of the bridge, the vaults being adapted in their modular division to the modular division of the track carriers, the vaults and the track carriers being equipped at their ends with end pieces, wherein the modules of the vaults have mutually identical constructions, wherein the end pieces of the vaults are connected in a torque-resistant manner with end pieces of the respective track carriers, and wherein the end pieces are constructed such that they are capable of compensating the length differences between the track carriers and the vaults in the case of different bridge lengths.

Advantageous features of respective various preferred embodiments of the invention are described herein and in the claims.

According to certain preferred embodiments of the invention, the load bearing capacity of the bridge track carriers is increased by two vaults which span the bridge and at which the bridge track carriers are suspended, for example, by way of tension members. Instead of tension members, arbitrary prestressable elements, particularly flexible belts, bands (for example, made of textile materials) can be used.

According to certain preferred embodiments of the invention, in their modular division, the two vaults are adapted to the division of the bridge track carriers. In this case, the individual modules of the vaults are mutually constructionally identical and particularly have the same length. Likewise, the individual modules of the track carriers are mutually constructionally identical and have the same length.

At their ends, the vaults and track carriers are in each case equipped with end pieces, the end pieces of the vaults being connected with the end pieces of the respective track carriers in a moment-resistant or torque-resistant manner, and the end pieces are constructed such that they are capable of balancing length differences (measure in the bridge span) between the track carriers and the vaults in the case of different bridge lengths.

As a result of the modular construction, the vault structure also adapts to the bridge length. Since the height of the vault is approximately proportional to the span, the loading of the individual components does not change very much over the span of the bridge.

Typical spans of the bridge according to the invention are in the range of up to approximately 30 m.

Advantages of Certain Preferred Embodiments of the Invention

The dismountable bridge can be stored in a volume-optimal and therefore air-transportable manner.

According to certain preferred embodiments of the invention, the vaults and track carriers are each constructed of identical modules, which significantly increase the variability of the bridge when it is in use. Damaged or lost components an be replaced by other constructionally identical components.

Bridge girders of a lower bearing capacity can be reinforced by means of the vaulting.

The effectiveness of the reinforcement is approximately proportional to the span of the bridge.

The reinforcement extends upward where, as a rule, space is always available. A collision with an obstacle can therefore be prevented in every case.

The vaulting is mounted on the already laid bridge and can also be demounted at a laid bridge without building back the entire bridge; that is,

- the weight of the vaulting of the bridge does not have to be laid, for example, in a free projection;
- defective parts can be exchanged without building back the bridge.

Other objects, advantages and novel features of the present invention will become apparent from the following detailed description of the invention when considered in conjunction with the accompanying drawings.

DETAILED DESCRIPTION OF THE DRAWINGS

Figure 1:
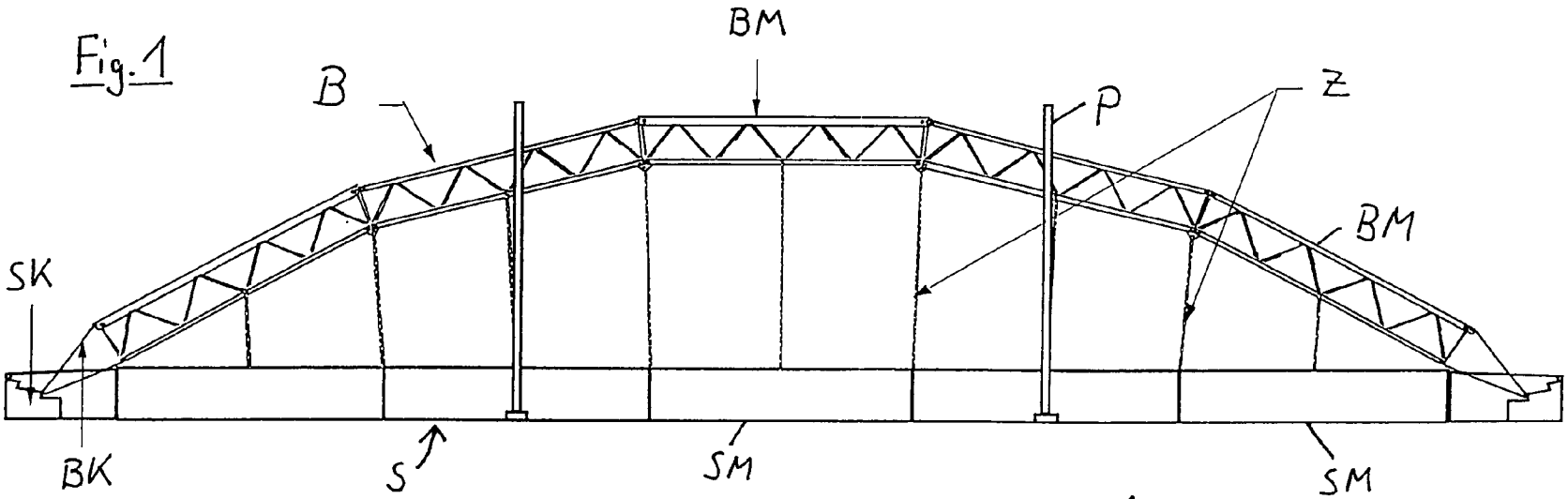
FIG. 1 is a view of a bridge according to a preferred embodiment of the invention, comprising 5 bridge modules.

FIG. 1 is a lateral view of a bridge constructed according to a preferred embodiment of the invention. It has a bridge girder which comprises two track carriers S as well as the bridge floor F (FIGS. 2, 3) as essential components. The track carriers S have a modular construction and, in the embodiment illustrated in FIG. 1, comprise 5 modules SM. The reinforcement of the bridge girders S is achieved by means of two vaults B vaulting the bridge, which, at their ends, are connected in a torque-resistant manner with the track carriers S, and on which the structure of the track carriers S is suspended by means of tension members Z.

Like the track carriers S of the bridge girder, the vaults B also have a modular construction consisting of several modules BM. The modules SM of the track carriers S have a mutually identical construction. Likewise, the modules BM of the vaults B have a mutually identical construction. The track carriers S and the vaults B are equipped at their ends in each case with end pieces (track carrier head SK, vaulting head BK). By way of these end pieces SK, BK, the vaults B and the track carriers S are connected with one another in a torque-resistant manner at the low ends of the vaults B.

Figure 4:
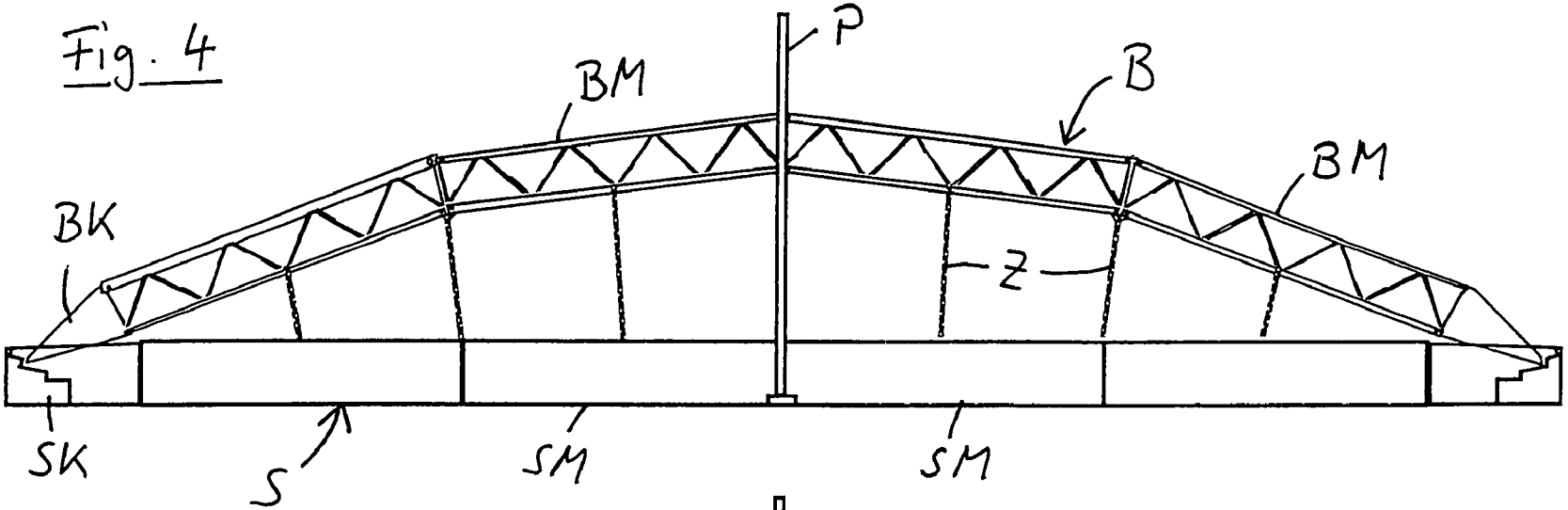
FIG. 4 is a view of a bridge according to certain preferred embodiments of the invention comprising 4 bridge modules.
Figure 5:
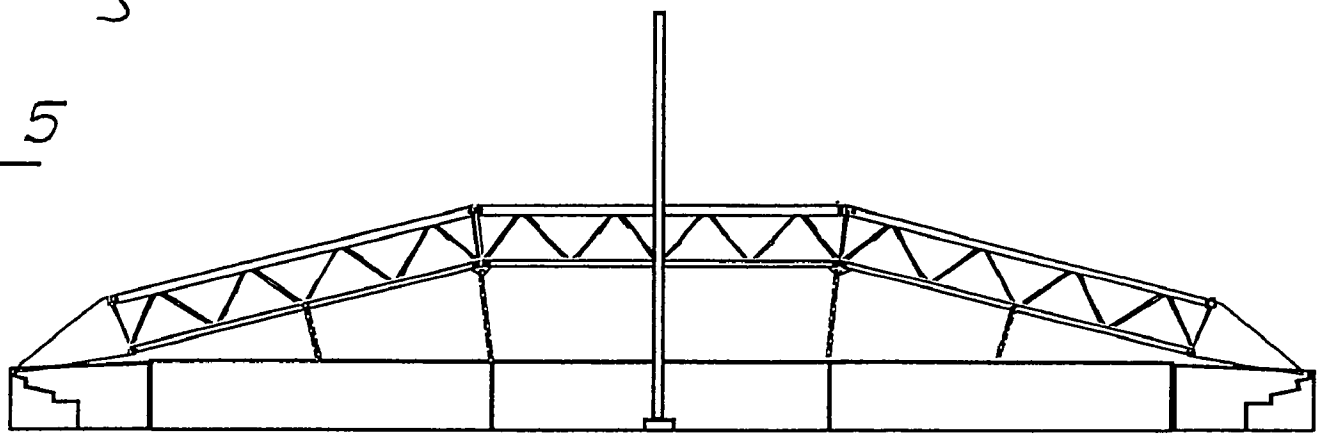
FIG. 5 is a view of a bridge according to certain preferred embodiments of the invention comprising 3 bridge modules.

As easily visible in FIGS. 1, 4 and 5, the tension members Z are slightly tilted out of the vertical position. This is a direct result of the construction principle according to certain preferred embodiments of the invention of using only mutually identical vault modules BM and mutually identical track carrier modules SM.

With respect to their modular construction, the vaults B and the track carriers S are adapted to one another, so that a vault module BM and a track carrier module SM together form a bridge module. The number of modules SM, BM is the same in the case of the vaults B and the track carriers S. The length of the vault modules BM is adapted to the length of the track carrier modules SM in such a manner that the bridge can be built in different lengths (that is, with a different number of bridge modules). The length difference, which depends on the number of bridge modules (lengths measure in the longitudinal direction of the bridge) between the vaults B and the track carriers S is compensated by the construction of end pieces SK, BK. The embodiment according to FIG. 1 shows as an example that adjustable clamping elements are provided on the track carrier head SK, by means of which different clamping positions become possible within a vertical plane. Like the embodiments of the bridge according to FIG. 4 (comprising 4 bridge modules) and FIG. 5 (comprising 3 bridge modules), depending on the number of bridge modules, the vaulting heads BK are fastened at different positions on the track carrier heads SK. In this embodiment, the positions differ in their horizontal coordinate (in the direction of the bridge span) as well as in their vertical coordinate.

The construction of the track carriers S and the vaults B is independent of the vaulting of the bridge girder according to the invention. Here, the known constructions can be used. Plate girders, box girders as well as lattice girders can be used for the track carriers S and the vaults B.

Figure 2:
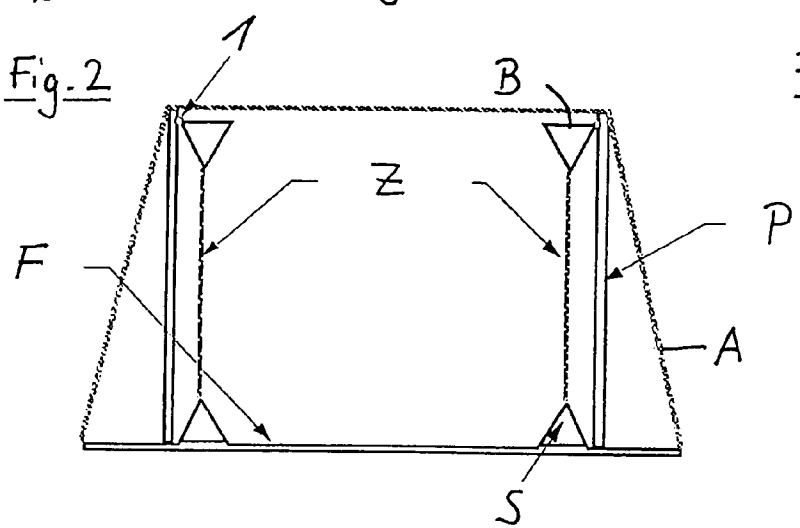
Figures 6A, 6B, 6C:
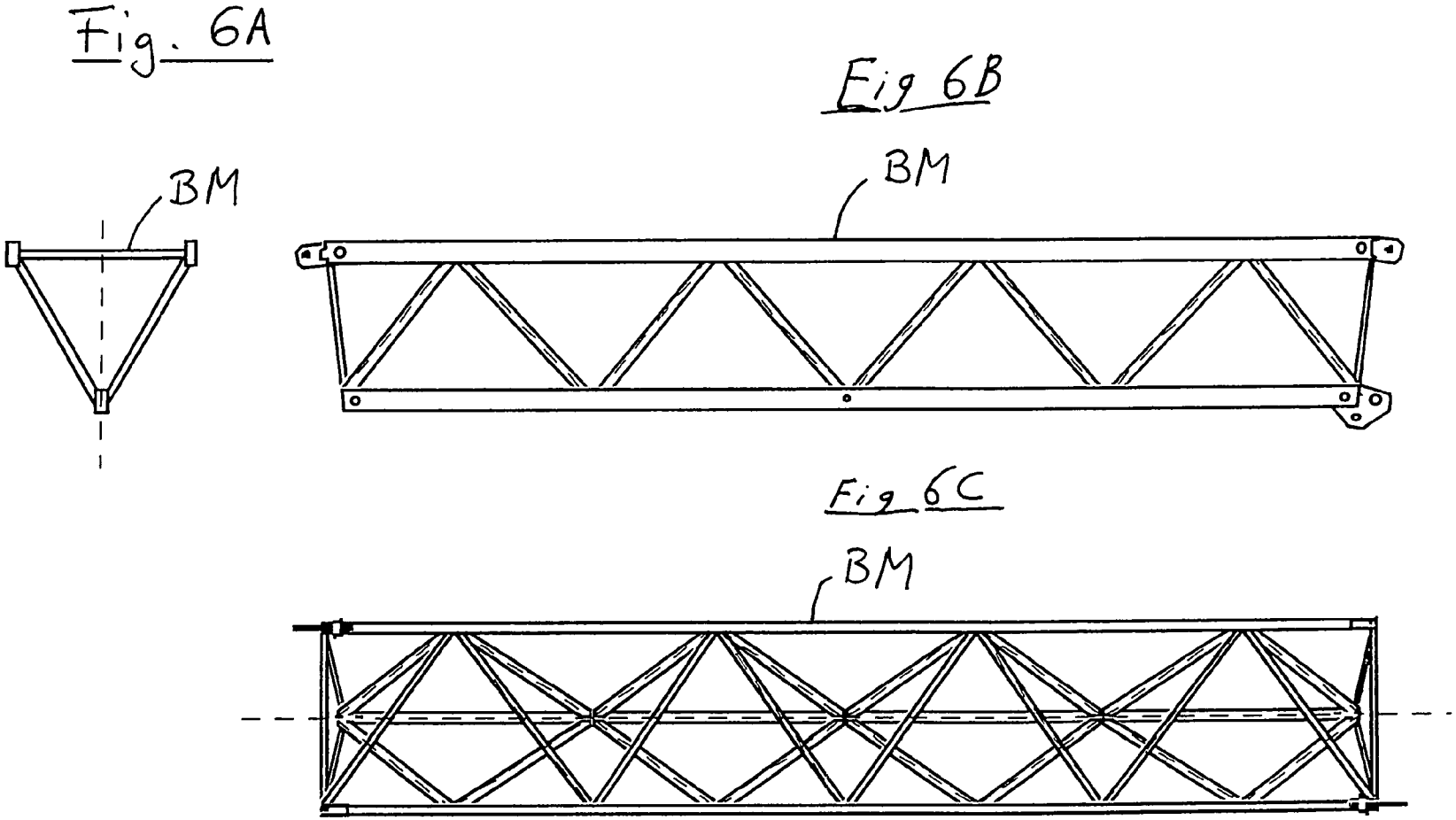
FIGS. 6A–6C are three different views of a module of the vault of a bridge according to respective preferred embodiments of the invention.

For this purpose, FIG. 2 shows an embodiment in which the track carrier S and the vaults B are constructed as triangular girders. They are each mutually connected by way of a tension member Z. According to the embodiment of FIG. 3, the track carriers S and the vaults B are constructed as box girders with a rectangular cross-section and are each connected by way of two tension members Z. FIGS. 6A–6C show modules BM of the vaulting which are constructed in a lattice construction with a triangular cross-section.

Figure 3:
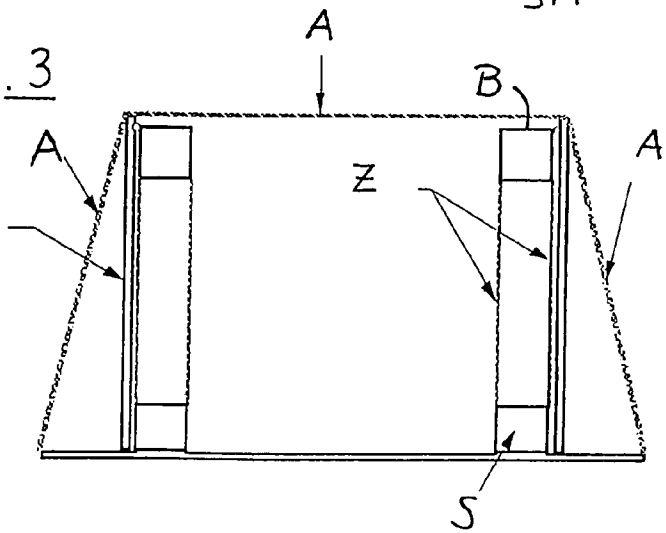
FIGS. 2 and 3 are sectional views transversely to the longitudinal direction of the bridge showing two different embodiments of the bridge according to the invention.

As illustrated in FIGS. 2 and 3, the vaults B can be stabilized by one or more pairs of posts P which are connected with the vaulting B (Position 1). In order to prevent a lateral buckling, a bracing by means of a cable A is additionally provided to the bridge floor structure F lengthened toward the outside.

In the illustrated preferred embodiments the track carrier end pieces or heads SK have connection points disposed on respective steps for selective connection with the vault end pieces or heads BK to accommodate the adjustment of the bridge length for the different numbers of modules forming the assembled bridge. The stepped connection points could also, or alternatively, be provided on the vault heads BK according to other contemplated embodiments.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Dismountable bridge, having two track carriers which, viewed in a longitudinal direction of the bridge, are divided into several identical track carrier modules, the two track carriers each being spanned by and being suspended at a vault, the vaults being divided into several identical length vault modules in the longitudinal direction of the bridge, the vaults being adapted in their modular division to the modular division of the track carriers, vault end pieces connectible in use with outermost ends of outermost ones of said vault modules when said vault modules are connected together to form said vaults, track carrier end pieces connectible in use with outermost ends of outermost ones of said track carrier modules when said track carrier modules are connected together to form said track carriers, wherein the vault end pieces are connected in a torque-resistant manner with respective track carriers end pieces, and wherein the vault end pieces and track carrier end pieces are constructed such that they are capable of compensating length differences between the track carriers and the vaults in the case of different bridge lengths.

2. Bridge according to claim 1, comprising a bridge floor structure attachable to the track carrier, wherein the vaults are stabilized by one or more pairs of posts which are braced by way of cables toward the bridge floor structure lengthened toward the outside.

3. Bridge according to claim 1, wherein the vault modules are constructed as plate girders or lattice girders.

4. Bridge according to claim 2, wherein the vault modules are constructed as plate girders or lattice girders.

5. Bridge according to claim 1, wherein the track carrier modules are suspended on the vault modules by means of tension members, including belts or other prestressable elements.

6. Bridge according to claim 2, wherein the track carrier modules are suspended on the vault modules by means of tension members, including belts or other prestressable elements.

7. Bridge according to claim 3, wherein the track carrier modules are suspended on the vault modules by means of tension members, including belts or other prestressable elements.

8. Bridge according to claim 4, wherein the track carrier modules are suspended on the vault modules by means of tension members, including belts or other prestressable elements.

9. Bridge according to claim 1, wherein the track carrier end pieces have several coupling points for the torque-resistant connection with the vault end pieces, these coupling points differing with respect to their position in the span direction of the bridge.

10. Bridge according to claim 2, wherein the track carrier end pieces have several coupling points for the torque-resistant connection with the vault modules end pieces, these coupling points differing with respect to their position in the span direction of the bridge.

11. Bridge according to claim 3, wherein the track carrier end pieces have several coupling points for the torque-resistant connection with the vault modules end pieces, these coupling points differing with respect to their position in the span direction of the bridge.

12. Bridge according to claim 4, wherein the track carrier end pieces have several coupling points for the torque-resistant connection with the vault end pieces, these coupling points differing with respect to their position in the span direction of the bridge.

13. Bridge according to claim 5, wherein the track carrier end pieces have several coupling points for the torque-resistant connection with the vault end pieces, these coupling points differing with respect to their position in the span direction of the bridge.

14. Bridge according to claim 8, wherein the track carrier end pieces have several coupling points for the torque-resistant connection with the vault end pieces, these coupling points differing with respect to their position in the span direction of the bridge.

15. A dismountable bridge kit comprising:

a plurality of equal length track carrier modules, a plurality of equal length vault modules operable in use to support the track carrier modules, at least two track carrier end pieces connectible in use with outermost ends of outermost ones of said track carrier modules when said track carrier modules are connected together to form a track carrier, and at least two vault end pieces connectible in use with outermost ends of outermost ones of said vault modules when said vault modules are connected together to form a vault, wherein the respective track carrier and vault end pieces are detachably lockingly engageable with one another and are configured to be connected to accommodate different lengths of a bridge assembly formed of respective different numbers of the track carrier modules and vault modules; and wherein said end pieces have respective vertically spaced connection structure operable to connect respective vault end pieces at different vertical positions with respect to said track carrier end pieces.

16. A bridge kit according to claim 15, wherein said end pieces have respective horizontally spaced connection structure operable to connect respective vault end pieces at different horizontal positions with respect to said track carrier end pieces.

17. A dismountable bridge kit comprising:

a plurality of equal length track carrier modules, a plurality of equal length vault modules operable in use to support the track carrier modules, at least two track carrier end pieces connectible in use with outermost ends of outermost ones of said track carrier modules when said track carrier modules are connected together to form a track carrier, and at least two vault end pieces connectible in use with outermost ends of outermost ones of said vault modules when said vault modules are connected together to form a vault, wherein the respective track carrier and vault end pieces are detachably lockingly engageable with one another and are configured to be connected to accommodate different lengths of a bridge assembly formed of respective different numbers of the track carrier modules and vault modules; and wherein said end pieces have respective horizontally spaced connection structure operable to connect respective vault end pieces at different horizontal positions with respect to said track carrier end pieces.

18. Dismountable vault bridge assembly comprising:

a plurality of similar length vault modules connectible together to form a variable length bridge vault structure, a plurality of similar length track carrier modules connectible to form a variable length bridge track carrier structure, first and second vault end pieces attachable to respective first and second opposite ends of the bridge vault structure, and first and second carrier end pieces attachable to respective first and second opposite ends of the track carrier structure, wherein said track carrier modules are suspended from the vault carrier modules, and said first vault end piece is attachable to said first track carrier end piece and said second vault end piece is attachable to said second track end piece to thereby form an assembled bridge of varying length depending on the number of vault modules and track carrier modules utilized, and wherein said end pieces are configured with selectively engageable connection positions for accommodating differences in relative lengths of the bridge vault structure and track carrier structure for different length bridges.

19. A bridge assembly according to claim 18, wherein said end pieces have respective horizontally spaced connection structure operable to connect respective vault end pieces at different horizontal positions with respect to said track carrier end pieces.

20. A bridge assembly according to claim 18, wherein said end pieces have respective vertically spaced connection structure operable to connect respective vault end pieces at different vertical positions with respect to said track carrier end pieces.

* * * * *